US007975890B2

(12) United States Patent
Tang

(10) Patent No.: US 7,975,890 B2
(45) **Date of Patent: *Jul. 12, 2011**

(54) SWITCHING MECHANISM FOR STAPLING MODES OF A STAPLER

(76) Inventor: Jhih-Siang Tang, Tali (TW)

( * ) Notice: Subject to any disclaimer, the term of this patent is extended or adjusted under 35 U.S.C. 154(b) by 61 days.

This patent is subject to a terminal disclaimer.

(21) Appl. No.: 12/289,167

(22) Filed: Oct. 22, 2008

(65) Prior Publication Data

US 2010/0051667 A1 Mar. 4, 2010

Related U.S. Application Data

(63) Continuation-in-part of application No. 12/230,185, filed on Aug. 26, 2008.

(51) Int. Cl.
*B25C 5/13* (2006.01)

(52) U.S. Cl. ..... 227/8; 227/130; 227/2

(58) Field of Classification Search ..... 227/8, 120, 227/130, 2, 107

See application file for complete search history.

(56) References Cited

U.S. PATENT DOCUMENTS 2,714,208 A * 8/1955 Jenny ..... 227/128
3,612,379 A * 10/1971 Panock ..... 227/8
3,784,077 A * 1/1974 Burke et al. ..... 227/8
4,629,106 A * 12/1986 Howard et al. ..... 227/8
5,083,694 A * 1/1992 Lemos ..... 227/8
5,137,197 A * 8/1992 Bauer ..... 227/8
5,551,620 A * 9/1996 Vallee ..... 227/8
5,551,621 A * 9/1996 Vallee ..... 227/8
5,692,663 A * 12/1997 Yang ..... 227/8
5,791,545 A * 8/1998 Lin ..... 227/8
5,797,533 A * 8/1998 Lee ..... 227/8
5,836,501 A * 11/1998 Lai ..... 227/8
5,862,969 A * 1/1999 Lee ..... 227/8
6,059,161 A * 5/2000 Chang et al. ..... 227/8
6,116,488 A * 9/2000 Lee ..... 227/8
6,145,727 A * 11/2000 Mukoyama et al. ..... 227/130
6,213,372 B1 * 4/2001 Chen ..... 227/8
6,357,647 B1 * 3/2002 Ou ..... 227/8
6,419,140 B1 * 7/2002 Chen ..... 227/8
6,422,446 B1 * 7/2002 Liu ..... 227/8
6,431,425 B1 * 8/2002 Moorman et al. ..... 227/8
6,450,387 B1 * 9/2002 Chen ..... 227/8
6,543,664 B2 * 4/2003 Wolfberg ..... 227/8
6,588,642 B1 * 7/2003 Wang et al. ..... 227/8
6,659,324 B1 * 12/2003 Liu ..... 227/8
6,857,547 B1 * 2/2005 Lee ..... 227/8
6,860,416 B1 * 3/2005 Chen ..... 227/8
6,886,729 B1 * 5/2005 Lee ..... 227/8
6,948,646 B2 * 9/2005 Huang ..... 227/8
6,953,137 B2 * 10/2005 Nakano et al. ..... 227/8

(Continued)

*Primary Examiner* — Lindsay Low
(74) *Attorney, Agent, or Firm* — Raymond Y. Chan; David and Raymond Patent Firm

(57) ABSTRACT

The purpose of this invention is to provide a switching mechanism for switching stapling modes of a stapler, which mainly comprises a trigger, a supporting member, a slide member, a spring, a hooking member and a torsion spring. When the safety device of the stapler is pushed, the slide member is pushed to open the air valve, and if the trigger is further pressed at this particular moment, the stapling counterforce will make the slide member escape the pressure from the safety device so as to finish a single stapling process. When the trigger is pressed first and then the safety device is pushed, the slide member is pushed to open the air valve, which makes the stapling process to continuous until the trigger is released. In other words, the above process makes a continuous stapling process.

20 Claims, 14 Drawing Sheets

U.S. PATENT DOCUMENTS

| | | | | |
|---|---|---|---|---|
| 7,070,080 | B2 * | 7/2006 | Lin | 227/8 |
| 7,073,697 | B2 * | 7/2006 | Lin | 227/8 |
| 7,143,918 | B2 * | 12/2006 | Aguirre et al. | 227/8 |
| 7,152,773 | B2 * | 12/2006 | Ke | 227/8 |
| 7,308,995 | B2 * | 12/2007 | Uchiyama et al. | 227/8 |
| 7,314,154 | B2 * | 1/2008 | Huang et al. | 227/8 |
| 7,322,426 | B2 * | 1/2008 | Aguirre et al. | 173/1 |
| 7,458,492 | B2 * | 12/2008 | Terrell et al. | 227/8 |
| 7,464,843 | B2 * | 12/2008 | Huang | 227/8 |
| 7,635,072 | B2 * | 12/2009 | Bo-Seob et al. | 227/8 |
| 2002/0056739 | A1 * | 5/2002 | Liu | 227/8 |
| 2002/0130154 | A1 * | 9/2002 | Wolfberg | 227/8 |
| 2005/0001001 | A1 * | 1/2005 | Nakano et al. | 227/8 |
| 2005/0023318 | A1 * | 2/2005 | Aguirre et al. | 227/8 |
| 2005/0139628 | A1 * | 6/2005 | Aguirre et al. | 227/8 |
| 2006/0027621 | A1 * | 2/2006 | Lin | 227/8 |
| 2006/0032885 | A1 * | 2/2006 | Lin | 227/8 |
| 2006/0213945 | A1 * | 9/2006 | Ke | 227/8 |
| 2006/0255086 | A1 * | 11/2006 | Aguirre et al. | 227/8 |
| 2007/0034660 | A1 * | 2/2007 | Terrell et al. | 227/8 |
| 2007/0125822 | A1 * | 6/2007 | Liu | 227/8 |
| 2008/0185415 | A1 * | 8/2008 | Huang | 227/8 |
| 2009/0108046 | A1 * | 4/2009 | Huang | 227/8 |
| 2009/0283566 | A1 * | 11/2009 | Tang | 227/8 |
| 2009/0314818 | A1 * | 12/2009 | Segura | 227/8 |
| 2010/0012700 | A1 * | 1/2010 | Perron et al. | 227/8 |

* cited by examiner

SWITCHING MECHANISM FOR STAPLING MODES OF A STAPLER

CROSS REFERENCE OF RELATED APPLICATION

This is a Continuation-in-part application that claims the benefit of priority under 35 U.S.C. ss119 to a non-provisional application Ser. No. 12/230,185, filed Aug. 26, 2008.

BACKGROUND OF THE INVENTION

The known existing switching mechanism (switching between single and continuous stapling) for a stapler employs an eccentric rod to switch the mode by pressing and spinning it. According to actual practice, however, it is found that the eccentric rod can not be positioned at its desired location well when switching modes between single and continuous stapling, thus under the vibration environment making the stapler lose the capability of switching modes easily. The proposed invention therefore is designed aiming to solve the aforementioned drawbacks.

BRIEF SUMMARY OF THE INVENTION

The purpose of this invention is to provide a switching mechanism for stapling modes of a stapler, which is more convenient to use compared to prior art.

The invention "A switching mechanism for switching stapling modes of a stapler", which enables the switching between single and continuous stapling modes, comprises a stapler main body, a trigger, a supporting member, a slide member, a spring, a hooking member and a torsion spring, wherein:

the trigger is hollow with openings on top and its adjacent rear side, and has a 1st pin and a 2nd pin. Further, there are two symmetrical pivot holes and stopper recess on upper locations of the two sidewalls of the trigger, and the two symmetrical pivot holes cooperate with a connecting pin to pivotally connect the trigger to the stapler main body; the supporting member has pivot holes at its bottom for pivotally connecting with the 15t pin, and also has symmetrical convex stoppers on top of its sidewall and a protrusion at its top; the slide member has a sliding recess in one side for sliding against the supporting member, a protrusion on top, furthermore, there is a hook hole at bottom rear side of the slide member; the spring is connected between the supporting and slide members; the hooking member is connected by the 2nd pin, and has a curved piece and a hook tip employed to pull the slide member; the torsion spring is fitted on the hooking member to give the hooking member a force to return to its original position.

When the safety device is pushed, the safety device further pushes the slide member to open the air valve, then at the moment, if the trigger is further pressed, the stapling counterforce will make the slide member escape the pressure from the safety device so as to finish a particular single stapling process. Next, when the trigger is pressed first and the safety device is then pushed to further pushing the slide member to open the air valve, stapling process will continue until the trigger is released. In other words, the above process then is a continuous stapling process.

DETAILED DESCRIPTION OF THE INVENTION

Figure 1:
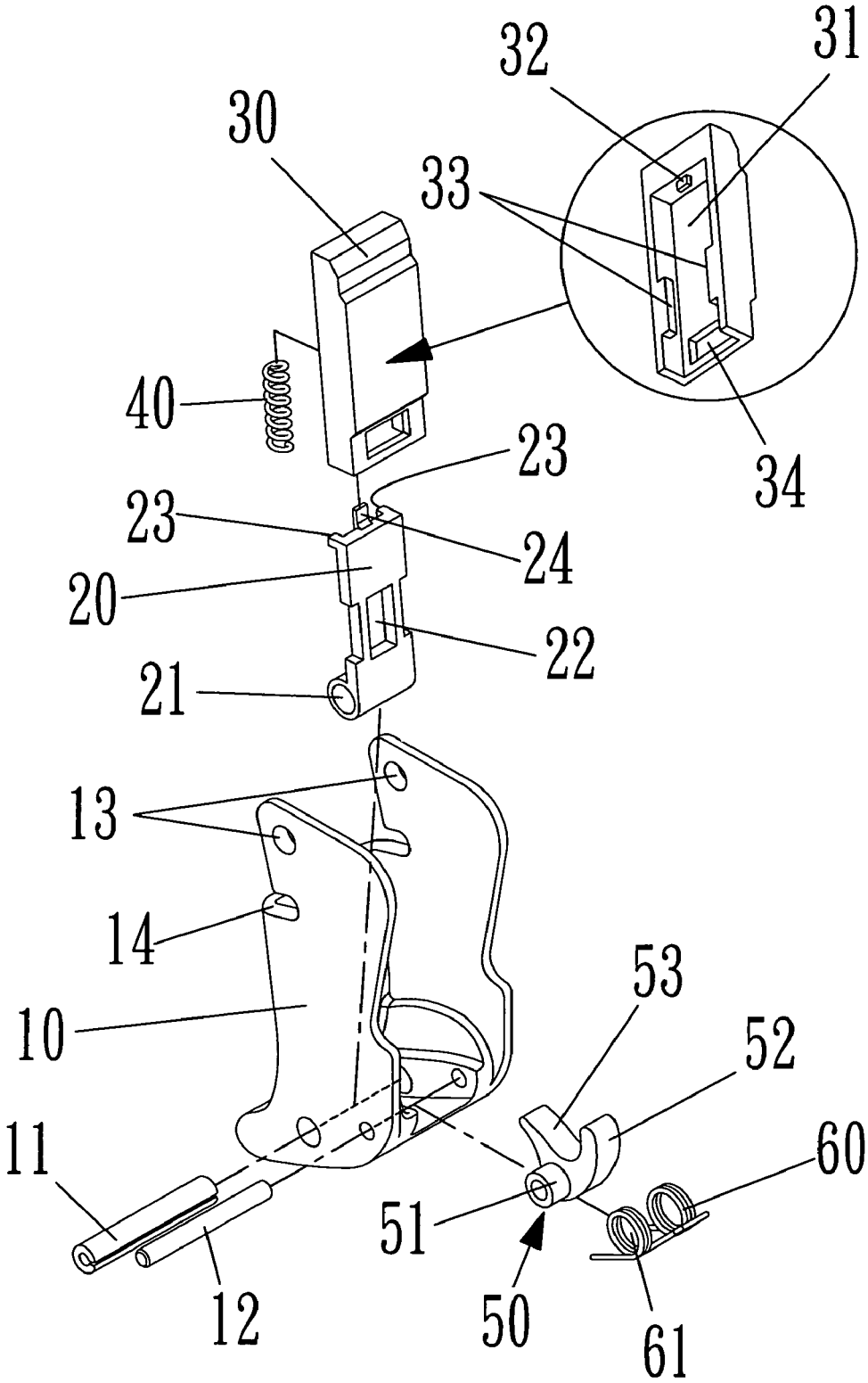
FIG. 1 is an exploded view to show of the preferred embodiment of the invention
Figure 2:
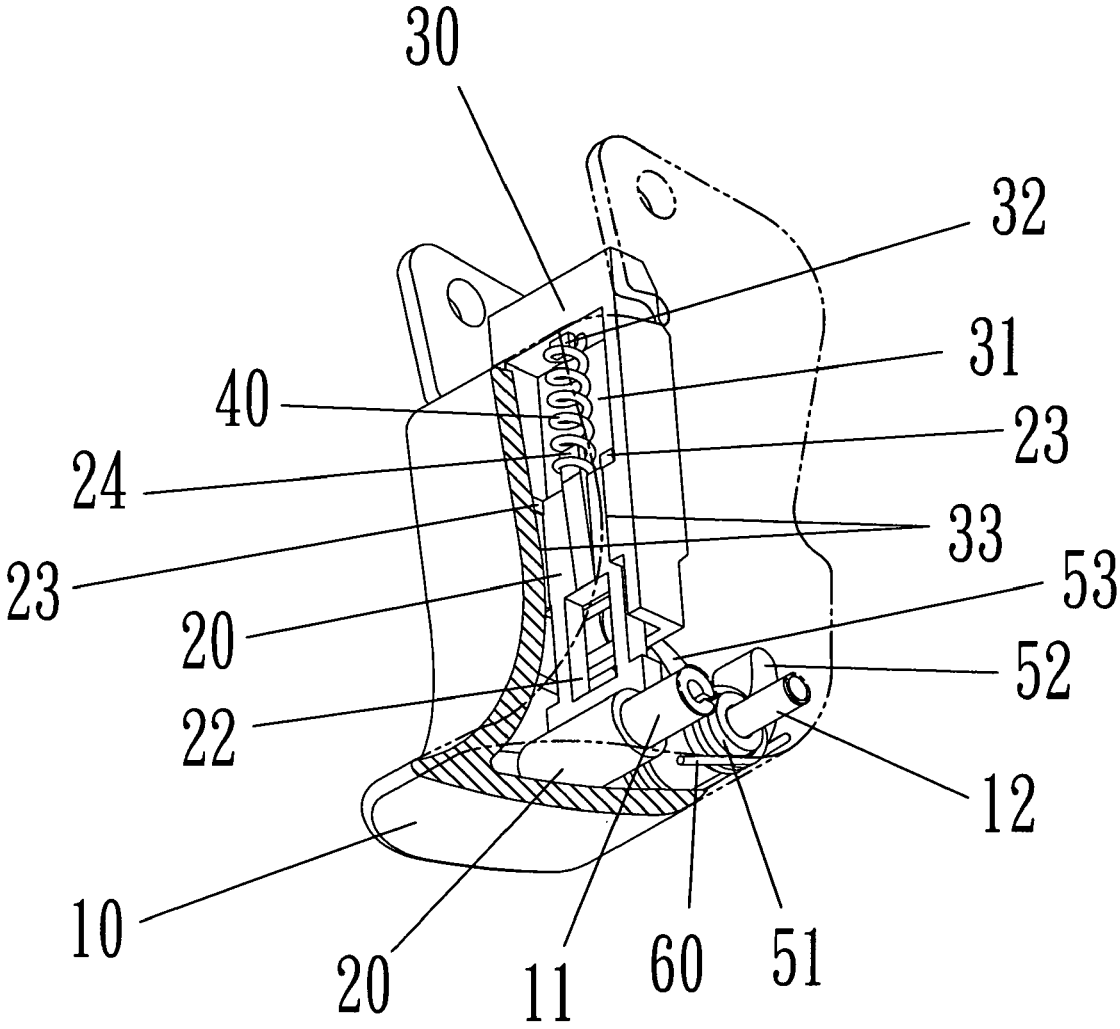
FIG. 2 is a 3-D cross sectional view of the preferred embodiment of the invention
Figure 3:
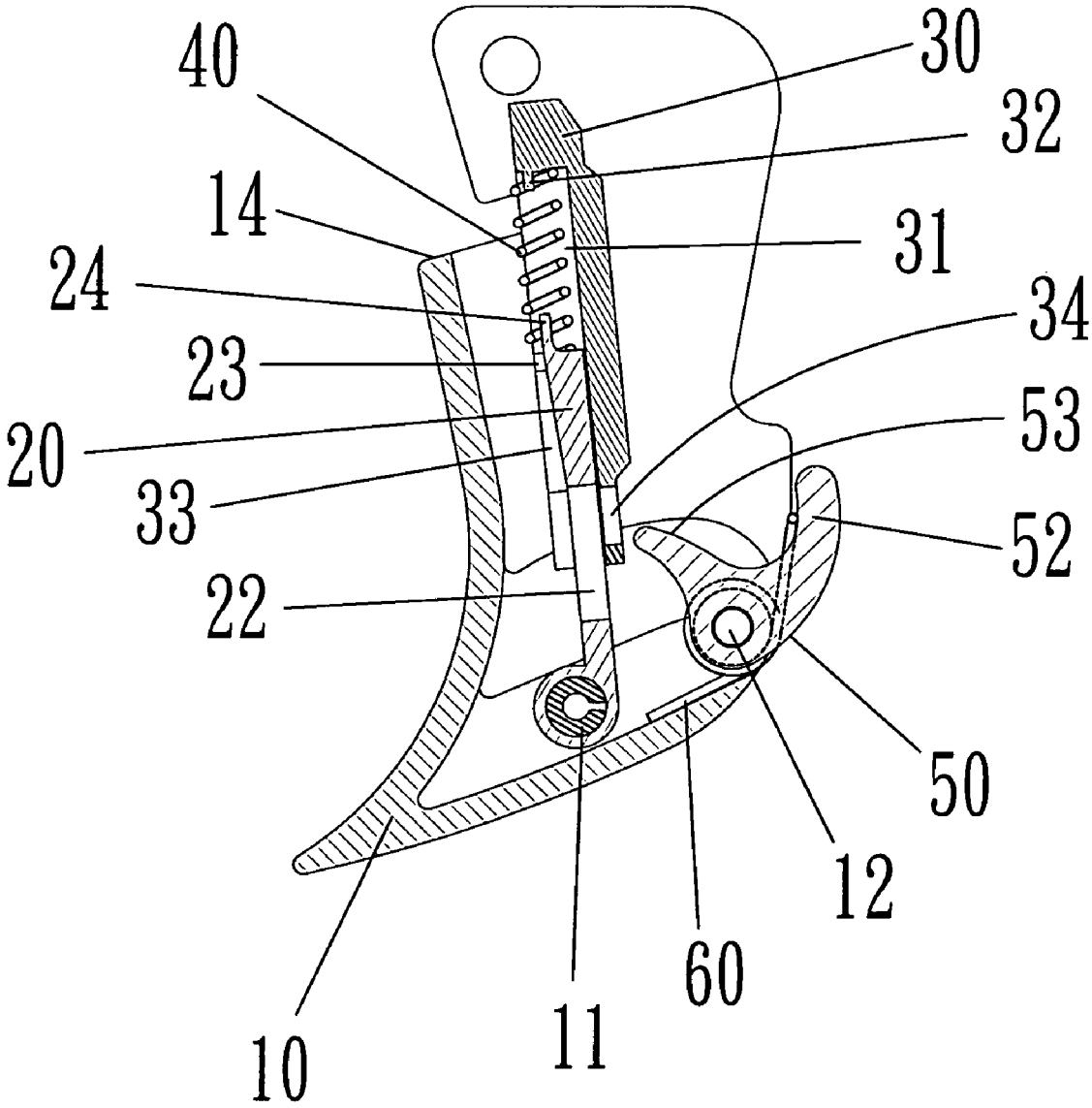
FIG. 3 is a cross sectional view of the preferred embodiment of the invention
Figure 4:
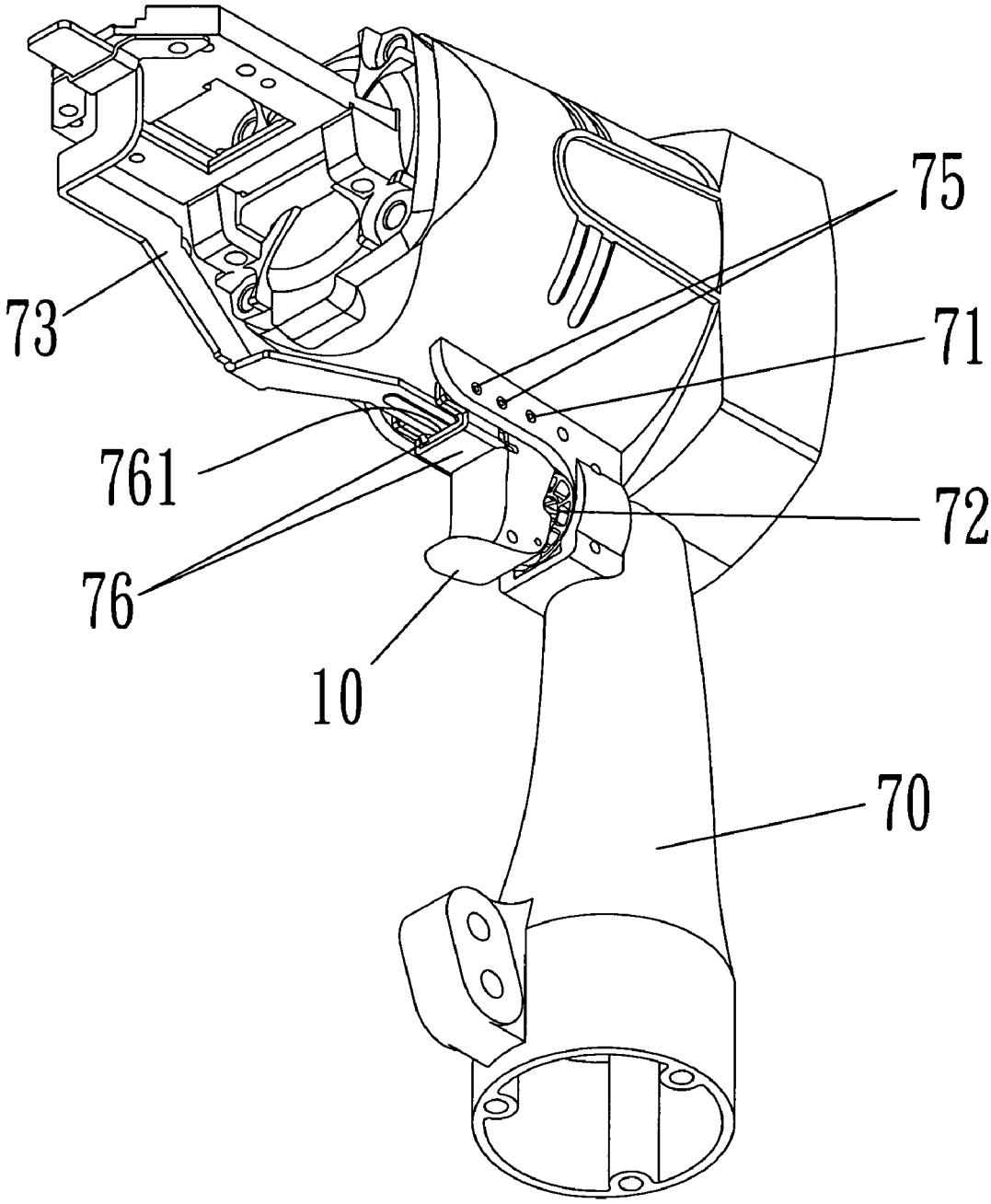
FIG. 4 is a perspective view of the preferred embodiment of the invention when connecting to the stapler main body
Figure 5:
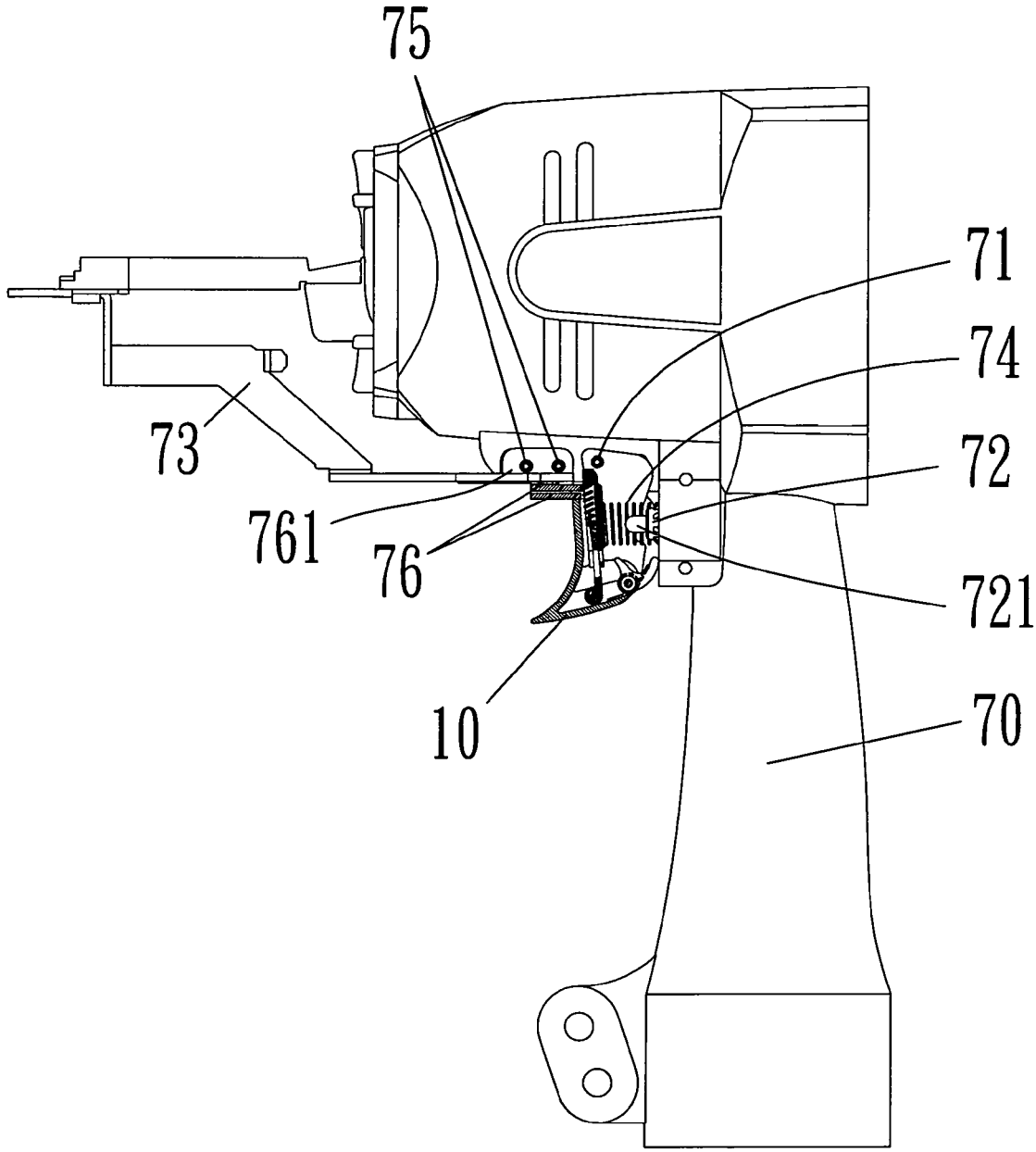
FIG. 5 is a partial cross sectional view of the FIG. 4

Please refer to following descriptions for the preferred embodiment for the invention. First, please refer to FIG. 1-3. The invention "A switching mechanism for stapling modes of a stapler", which enables the switching between single and continuous stapling, comprises a trigger 10, a supporting member 20, a slide member 30, a spring 40, a hooking member 50 and a torsion spring 60, wherein:

The trigger 10 is hollow with openings on top and its adjacent rear side, and has a 1st pin 11 and a 2nd pin 12 crossing between the sidewalls of the trigger 10 at its lower position with the 2nd pin 12 closer to the open rear side. Further, there are two symmetrical pivot holes 13 and stopper recess 14 on upper locations of the two sidewalls of the trigger 10. The two symmetrical pivot holes 13 cooperate with a connecting pin 71 to pivotally connect the trigger 10 to the stapler main body 70, and the two symmetrical stopper recess 14 cooperate with a guiding plate 76 of the stapler main body 70 to well position the trigger 10 (as shown in FIGS. 4, 5).

The supporting member 20 has a pivot hole 21 at its bottom for pivotally connecting with the $1^{st}$ pin 11, and a penetrating hole 22 in its middle location for allowing the hook tip 53 of the hooking member 50 to move through when it swings. Further, the supporting member 20 also has symmetrical convex stoppers 23 on top of its sidewall and a $1^{st}$ protrusion 24 at its top.

The slide member 30 has a sliding recess 31 in one side with an opening at its bottom so to allow the supporting member 20 to slide against the recess 31. Further, a 2nd protrusion 32 extends from a top inner end of the recess 31, and there are two symmetrical convex blockers 33 in the inner lower middle locations of the recess 31 for cooperating with the convex stoppers 23 to limit the range of which the slide member 30 can slide against the supporting member 20 (namely, the slide member 30 slides to its farthest against the supporting member 20 when the convex blockers 33 are stopped against the convex stoppers 23). Furthermore, there is a hook hole 34 at bottom rear side of the slide member 30 for the purpose of cooperating with the hook tip 53.

The spring 40 is connected between and fixed firmly by the 1st and 2nd protrusions 24, 32. The hooking member 50 comprises a pivot tube 51 for pivotally connecting with the 2nd pin 12, a curved piece 52 to be pushed to swing the hooking member 50, and a hook tip 53 employed to hook the hook hole 34 and then pull the slide member 30 sliding against the supporting member 20.

The torsion spring 60 is fitted on the pivot tube 51 of the hooking member 50 through its spring hole 61 with its both sides staying against at inner bottom face of the trigger 10 and one side of the curve piece 52 respectively.

The FIGS. 4 and 5 shows the entire stapler and the assembly of the invention and the stapler main body 70. The trigger 10 is connected firmly to the stapler main body 70 with the connecting pin 71 and the pivot holes 13. The connection position is located between the air valve 72 and the safety device 73, and the air valve 72 is located at about the same horizontal level as the middle part of the slide member 30. There is a spring 74 set between the air valve 72 and the slide member 30. Further, a guiding plate 76 with a guiding groove 761 on its top is fixed by connecting pins 75, which is employed to guide the safety device 73 to ensure smooth movements horizontally.

Figure 6:
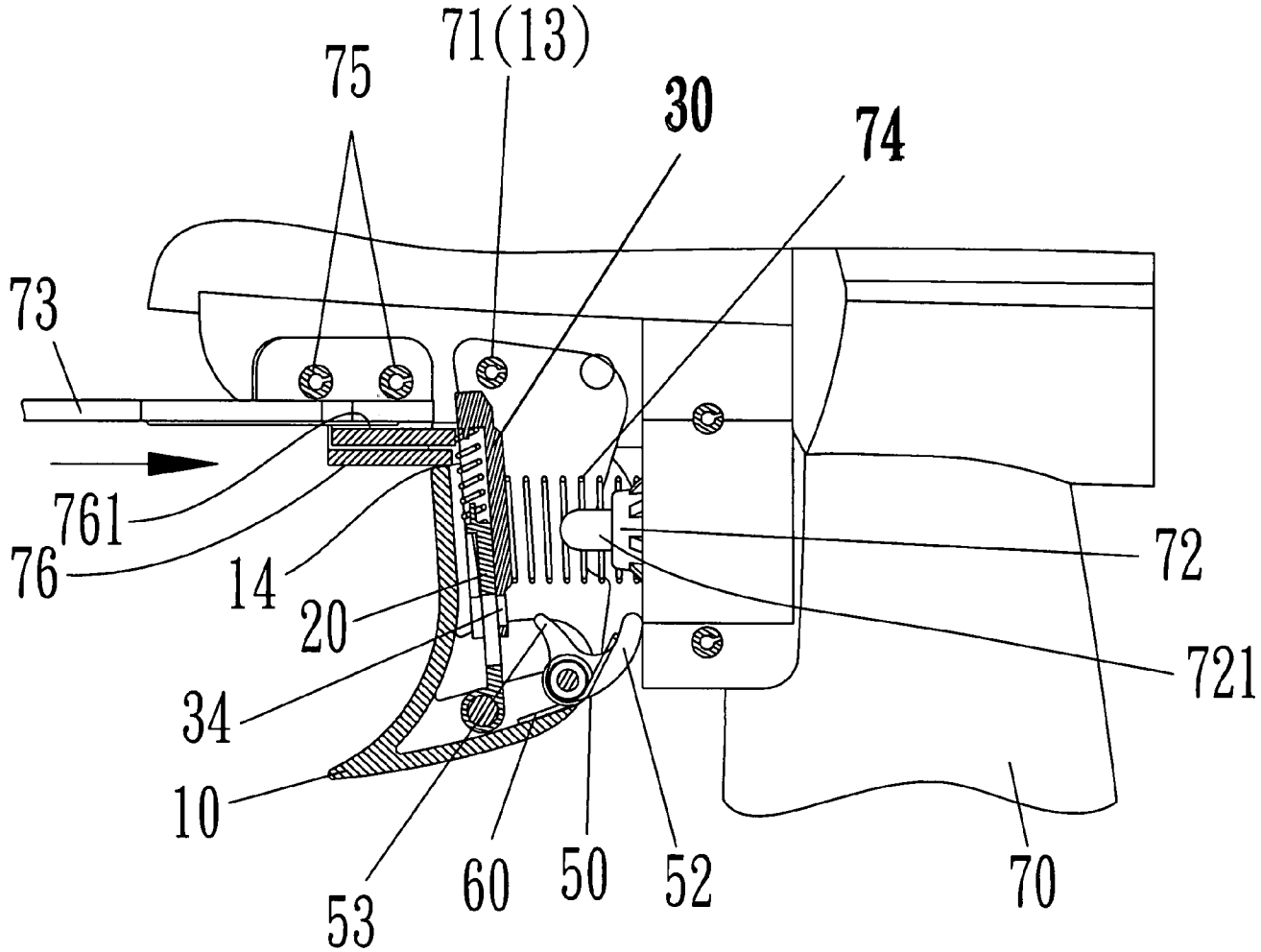
FIG. 6 is a cross sectional view (I) of the preferred embodiment of the invention when operating single stapling mode
Figure 7:
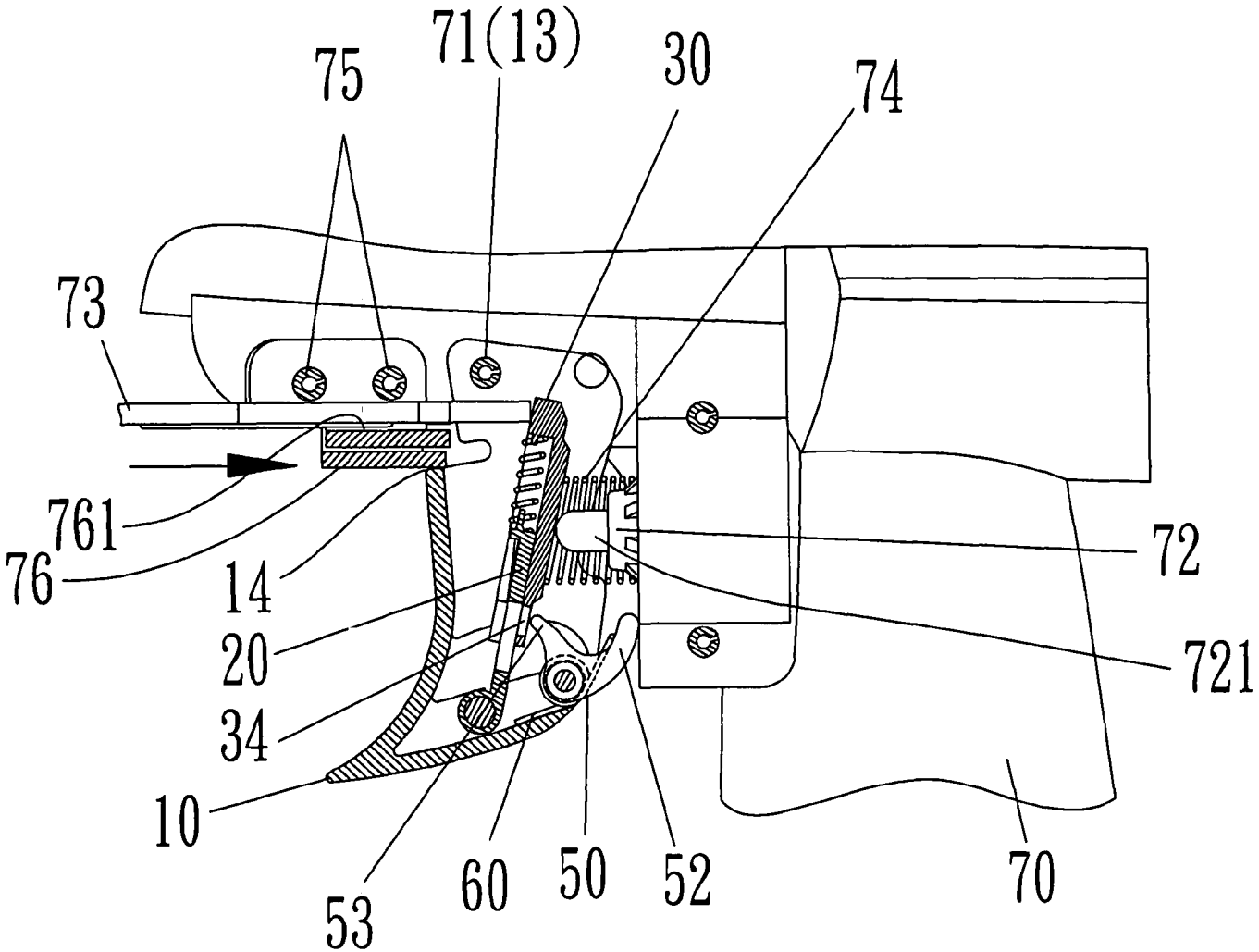
FIG. 7 is a cross sectional view (II) of the preferred embodiment of the invention when operating single stapling mode
Figure 8:
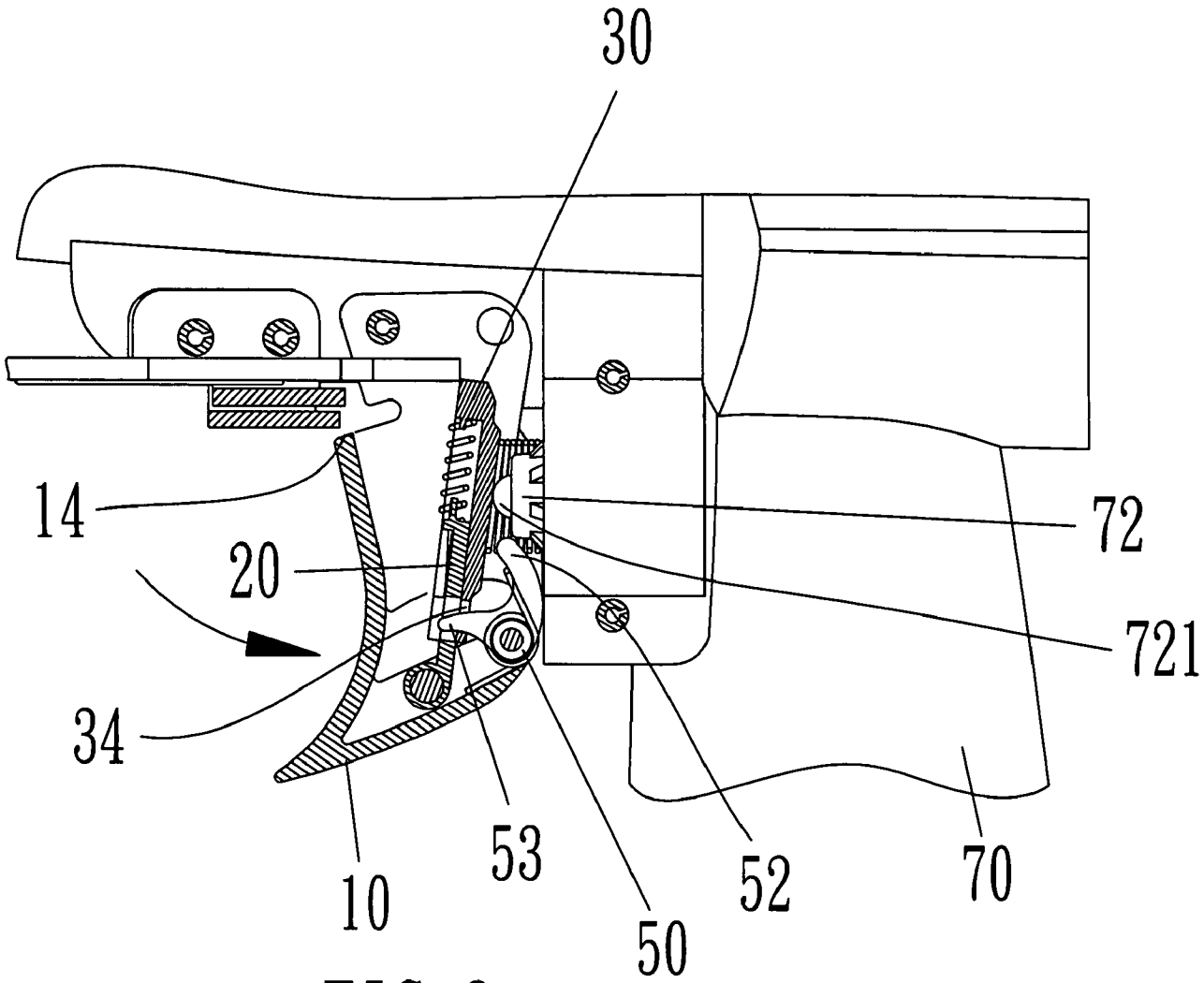
FIG. 8 is a cross sectional view (III) of the preferred embodiment of the invention when operating single stapling mode
Figure 9:
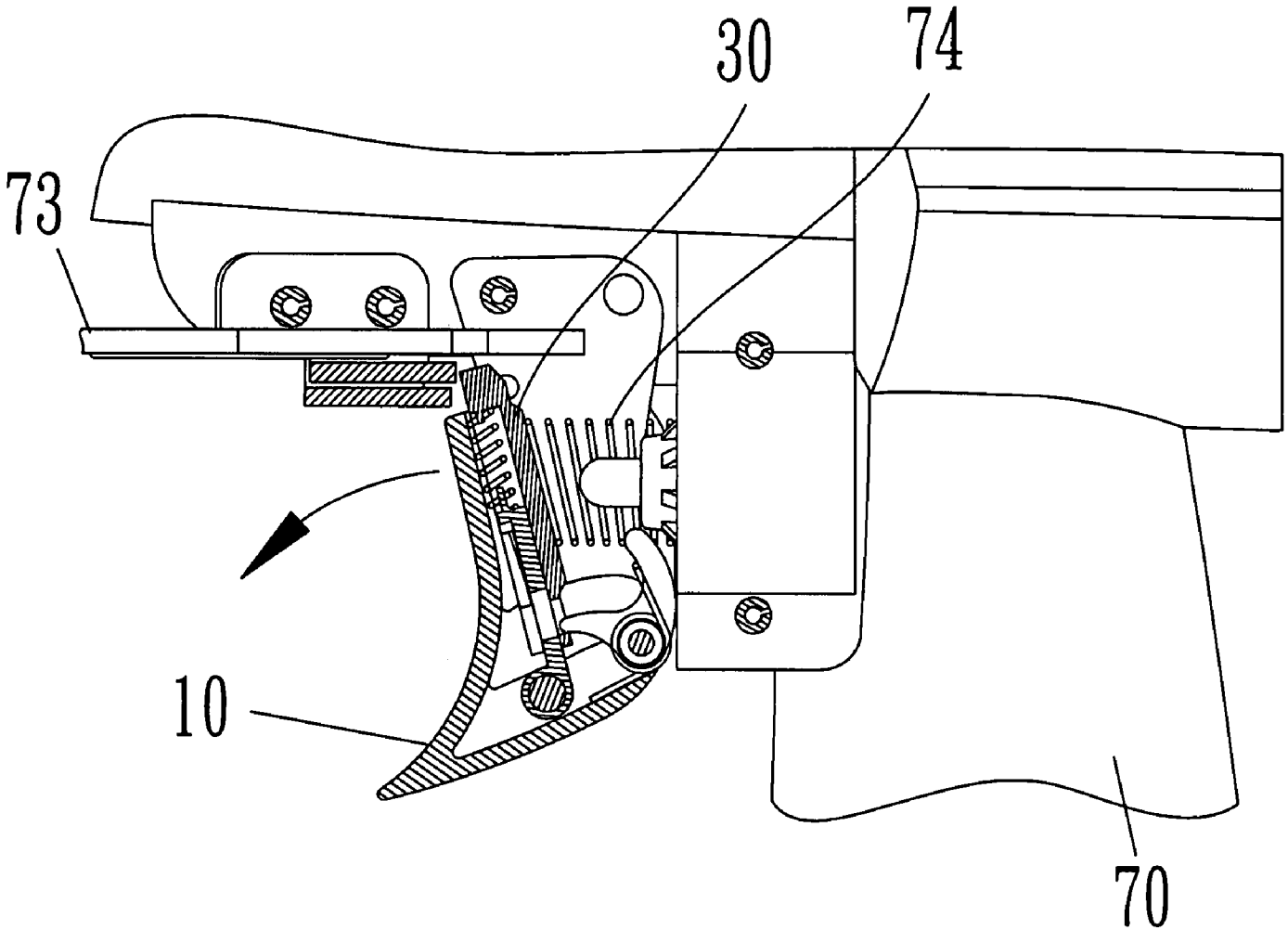
FIG. 9 is a cross sectional view (IV) of the preferred embodiment of the invention when operating single stapling mode

Now please refer to FIGS. 6-9 for illustrations on how a single-stapling mode works. FIG. 6 shows the status when the stapler stays still. Then as shown in FIG. 7, when the safety device 73 is pushed against the surface of a work piece (not shown in the figures), the safety device 73 will then pushes the top part of the slide member 30 to compress the compression spring 74, and stops at a proper position. Then at the moment, if the trigger 10 is further pressed (as shown in FIG. 8), the curved piece 52 of the hooking member 50 will then be pushed by the stapler main body 70, making the hooking member 50 swing, and further making the hook tip 53 hook into the hook hole 34 and pulling the slide member 30 to slide against the supporting member 20. In the midway of sliding of the slide member 30, the valve activator 721 is pressed to make the air valve 72 in OPEN mode, thus letting air through to activate a single stapling step. And then when the slide member 30 slides till its limit, the top part of the slide member 30 will escape the pressure from the safety device 73, and then the compression spring 74 pushes the slide member 30 back till it stays against the front inner wall of the trigger 10 again. The above process then makes a single stapling.

Figure 10:
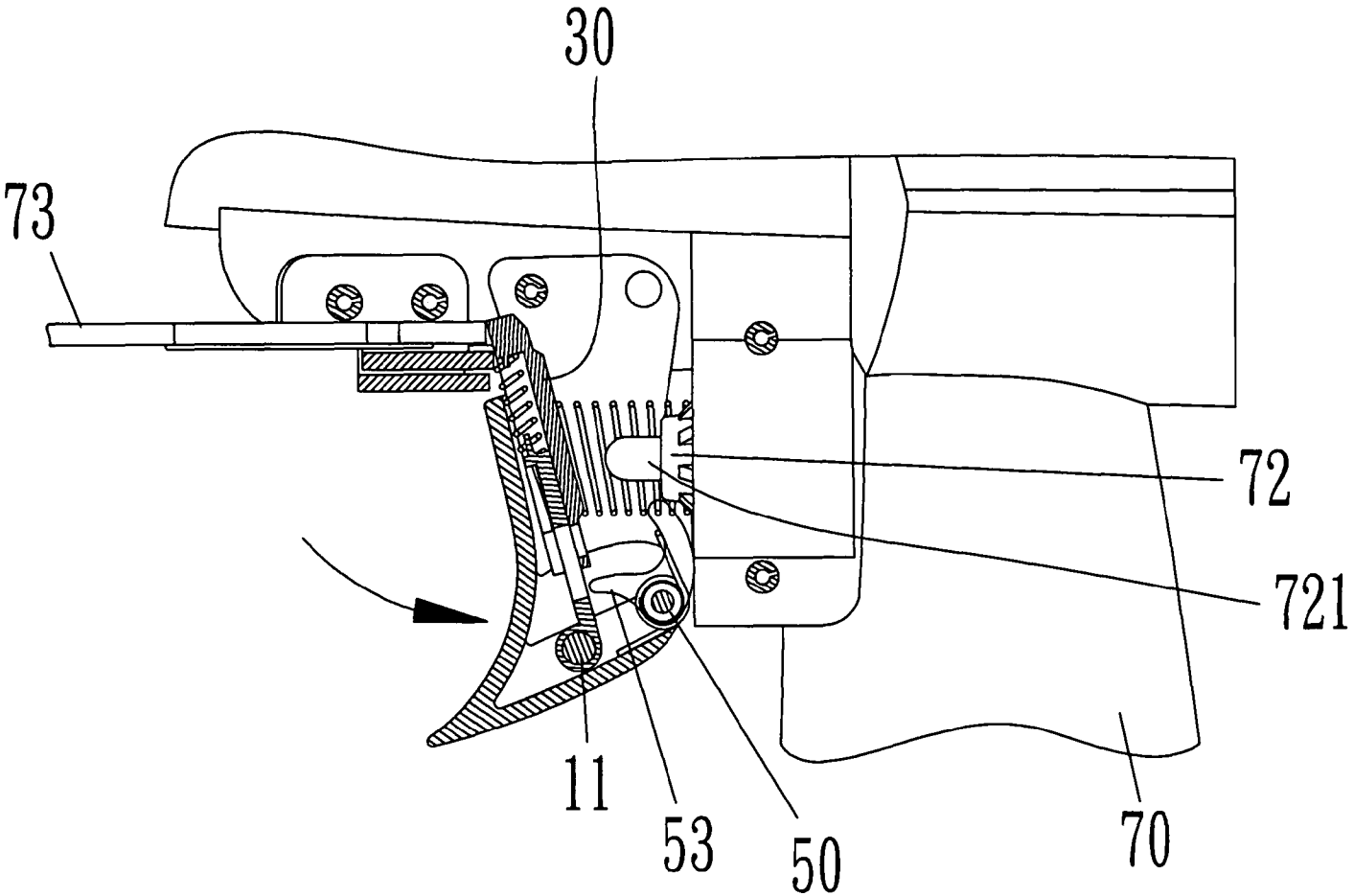
FIG. 10 is a cross sectional view (I) of the preferred embodiment of the invention when operating continuous stapling mode
Figure 11:
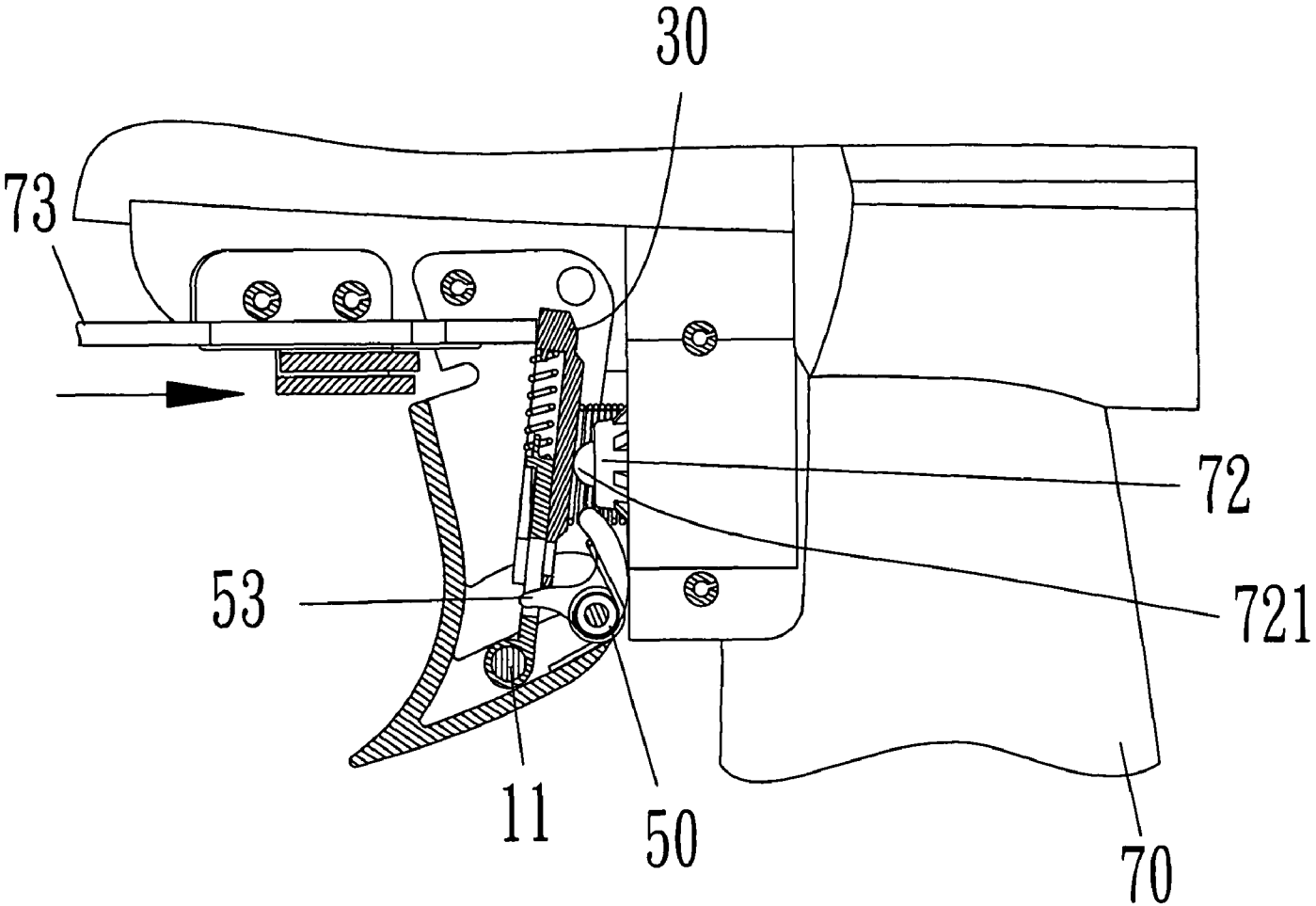
FIG. 11 is a cross sectional view (II) of the preferred embodiment of the invention when operating continuous stapling mode
Figure 12:
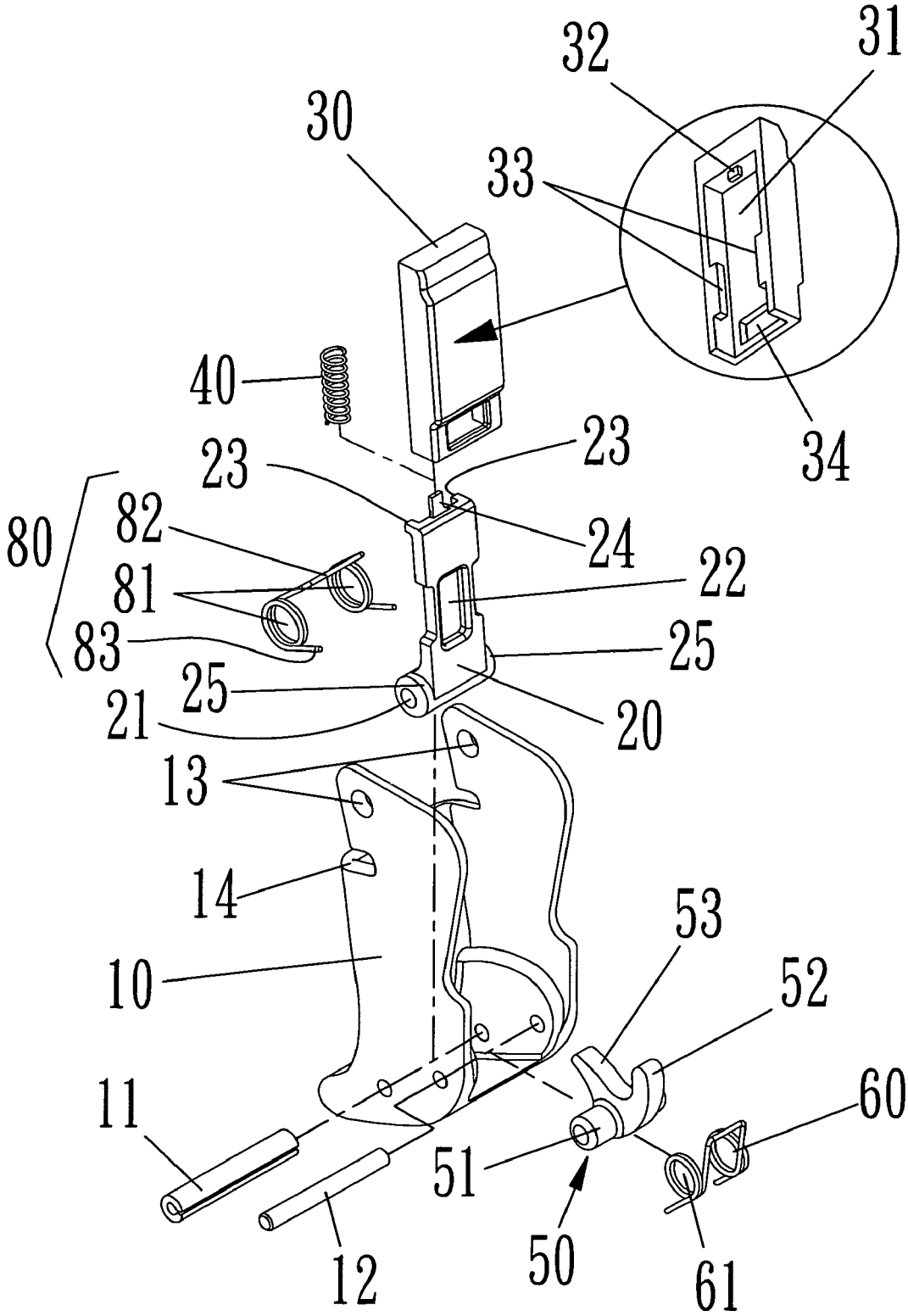
FIG. 12 is an exploded view to show of the $2^{nd}$ preferred embodiment of the invention

Next please refer to FIGS. 10-12 for illustrations on how a continuous-stapling mode works. First, when the trigger 10 is pressed, the curved piece 52 of the hooking member 50 will then be pushed by the stapler main body 70, making the hooking member 50 swing, and making the hook tip 53 move right below hook hole 34. Secondly, push the safety device 73 against the surface of a work piece (not shown in the figures), which will further pushes the top part of the slide member 30 to compress the compression spring 74 till the slide member 30 presses the valve activator 721. Thus, the air valve 72 will be in OPEN mode, and it will keep stapling continuously until the trigger 10 is released. In other words, the above process then makes a continuous stapling.

Figure 13:
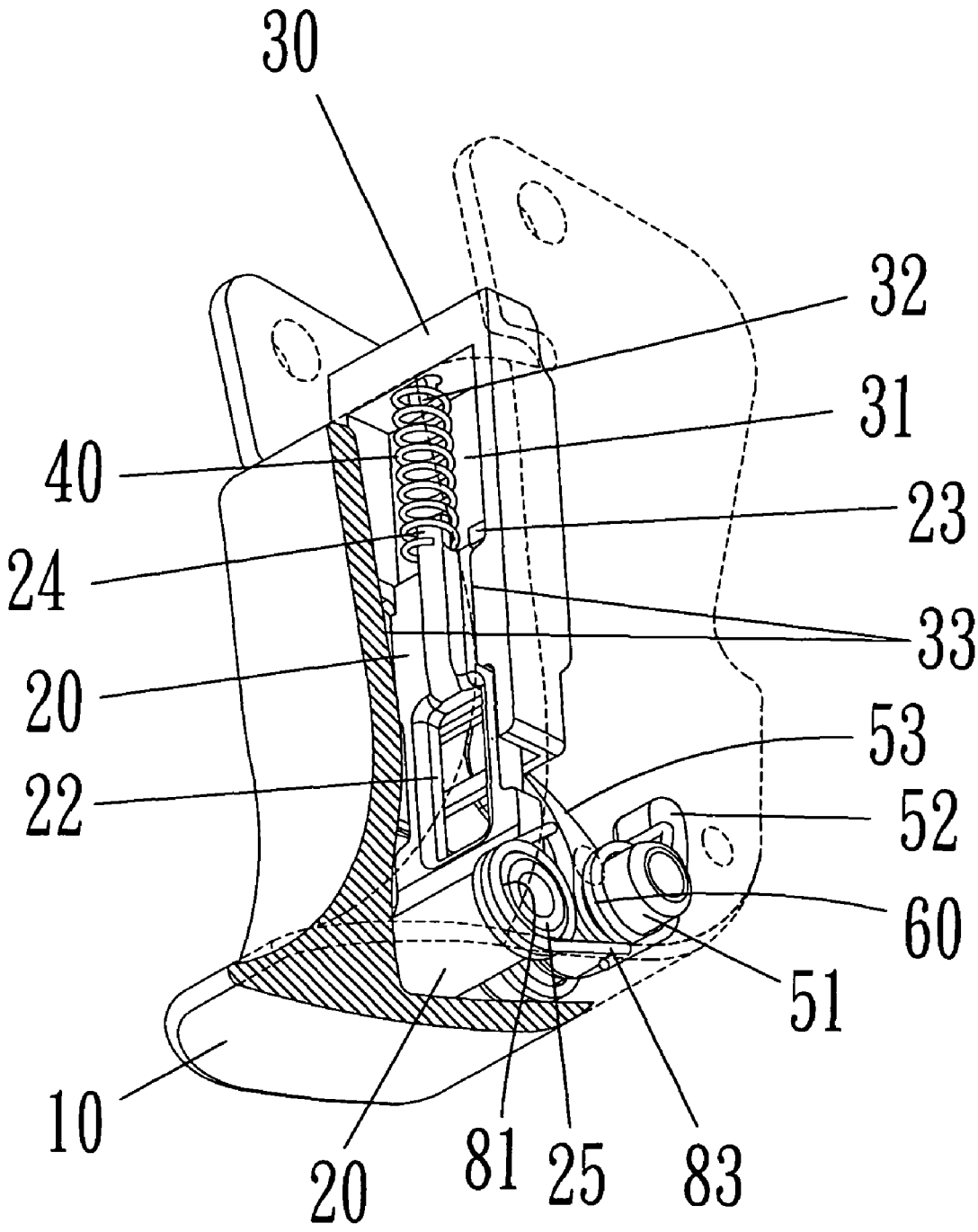
FIG. 13 is a 3-D cross sectional view of the $2^{nd}$ preferred embodiment of the invention
Figure 14:
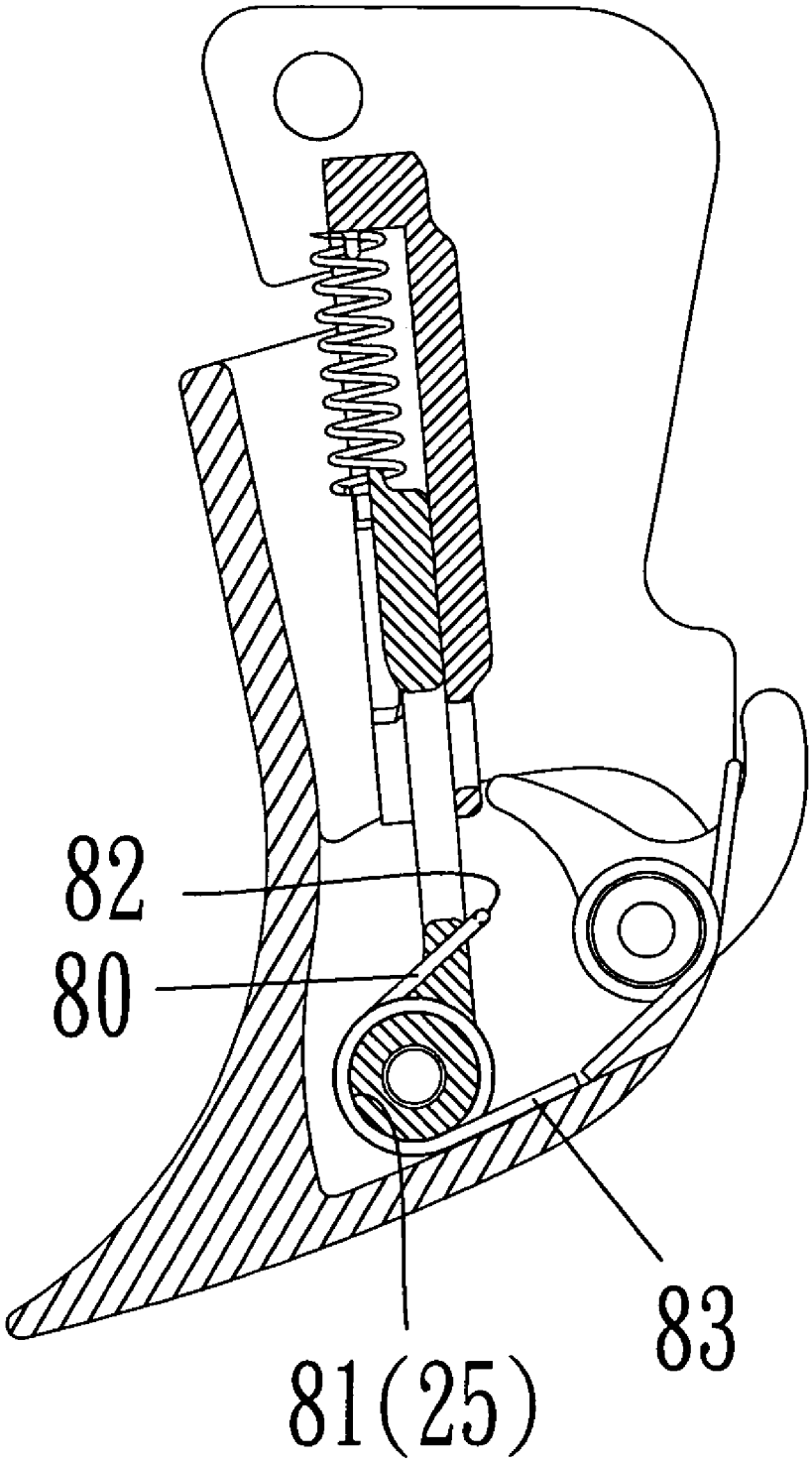
FIG. 14 is a cross sectional view of the $2^{nd}$ preferred embodiment of the invention

Further please refer to FIGS. 12-14, which illustrate the 2nd preferred embodiment for this invention. An extra torsion spring 80 can be added on the supporting member 20 so as to push the supporting member 20 to stay at a position against the front inner wall of the trigger 10, which can help to push back the safety device 73 to its original position. The detailed feature is: the supporting member 20 further comprises two symmetrical pivot tubes 25 on its both sides such that the torsion spring 80 is able to fit on the supporting member 20. The torsion spring 80 has two symmetrical spring holes 81 on its both sides, a connecting bar 82 between the two spring holes 81, and two symmetrical extended feet 83 at its both ends. Due to the torsion force, the connecting bar 82 stays against the back face of the supporting member 20, and the two extended feet 83 push against the inner bottom face of the trigger 10, therefore the supporting member 20 will be always pushed forward till its designated position as its normal position when the stapler is not in use.

With all aforementioned, the invention deserves grant of a patent based on its capability of industrial application and absolute novelty. The example illustrated above is just an exemplary embodiment for the invention, and shall not be utilized to confine the scope of the patent. Any equivalent modifications within the scope of claims of the patent shall be covered in the protection for this patent.

What is claimed is:

1. A switching mechanism for stapling modes of a stapler that comprises: a stapler main body, a trigger, a supporting member, a slide member, a spring, a hooking member and a torsion spring; wherein:

the trigger has two sidewalls, a 1st pin and a 2nd pin provided at a bottom end of the trigger, and two symmetrical pivot holes and two symmetrical stopper recesses positioned on upper locations of its two sidewalls respectively;

wherein the supporting member has pivot holes at a bottom end thereof, and a 1st protrusion at a top end thereof, wherein the pivot holes are adapted for connecting to the two symmetrical pivot holes of the trigger respectively;

wherein the slide member has a sliding recess in one side for allowing the supporting member to slide against the recess, a 2nd protrusion on top, and a hook hole at a bottom end thereof;

wherein the spring is connected-between the said 1st and 2nd protrusions; wherein the hooking member is connected to the said trigger by the said 2nd pin, and has a curved piece and a hook tip; wherein the torsion spring is fitted on the said hooking member.

2. A switching mechanism for stapling modes of a stapler of claim 1, wherein the said pivot holes of the said trigger are for the purpose of connecting the said trigger to the stapler main body, wherein the said trigger is hollow, has openings on a top end thereof and a portion which is adjacent to a rear side thereof for housing the said supporting member, slide member, hooking member, and torsion spring.

3. A switching mechanism for stapling modes of a stapler of claim 2, wherein the said supporting member has a pivot hole at a bottom end thereof for fitting with the said 1st pin so as to allow swinging movement.

4. A switching mechanism for stapling modes of a stapler of claim 1, wherein the said supporting member has a penetrating hole near a middle portion thereof for allowing the said hook tip of the said hooking member to move through during mutual interactions.

5. A switching mechanism for stapling modes of a stapler of claim 1, wherein the said supporting member has symmetrical convex stoppers on top of a sidewall thereof, and the said slide member has an opening at a bottom end thereof for allowing sliding movement and two symmetrical convex blockers in its an inner lower middle locations respectively.

6. A switching mechanism for stapling modes of a stapler of claim 4, wherein the said spring is a compression spring.

7. A switching mechanism for stapling modes of a stapler of claim 4, wherein the said hooking member comprises a pivot tube for pivotally fitting with the 2nd pin.

8. A switching mechanism for stapling modes of a stapler of claim 1, wherein the said torsion spring is fitted with the said pivot tube of the said hooking member.

9. A switching mechanism for stapling modes of a stapler of claim 1, wherein both sides of the said torsion spring push against an inner bottom face of the said trigger and one side of the said curved piece respectively.

10. A switching mechanism for stapling modes of a stapler of claim 1, wherein the said supporting member further has a torsion spring fitted with it, so that the said supporting member is always pushed to its normal position when the stapler is not in use.

11. A switching mechanism for stapling modes of a stapler of claim 1, wherein the said supporting member further comprises two symmetrical pivot tubes on two sides with a further torsion spring being fitted thereon, wherein the said further torsion spring has two symmetrical spring holes on two sides, a connecting bar between the two said spring holes staying against a back face of the supporting member, and two symmetrical extended feet at two ends pushing against an inner bottom face of the trigger.

12. A switching mechanism for stapling modes of a stapler of claim 2, wherein the said supporting member has a penetrating hole near a middle portion thereof for allowing the said hook tip of the said hooking member to move through during mutual interactions.

13. A switching mechanism for stapling modes of a stapler of claim 12, wherein the said supporting member has symmetrical convex stoppers on top of a sidewall thereof, and the said slide member has an opening at a bottom end thereof for allowing sliding movement and two symmetrical convex blockers in an inner lower middle locations respectively.

14. A switching mechanism for stapling modes of a stapler of claim 13, wherein the said spring is a compression spring.

15. A switching mechanism for stapling modes of a stapler of claim 14, wherein the said hooking member comprises a pivot tube for pivotally fitting with the 2nd pin.

16. A switching mechanism for stapling modes of a stapler of claim 14, wherein the said torsion spring is fitted with the said pivot tube of the said hooking member.

17. A switching mechanism for stapling modes of a stapler of claim 16, wherein both sides of the said torsion spring push against an inner bottom face of the said trigger and one side of the said curved piece respectively.

18. A switching mechanism for stapling modes of a stapler of claim 13, wherein the said supporting member further has a torsion spring fitted with it, so that the said supporting member is always pushed to its normal position when the stapler is not in use.

19. A switching mechanism for stapling modes of a stapler of claim 17, wherein the said supporting member further has a torsion spring fitted with it, so that the said supporting member is always pushed to its normal position when the stapler is not in use.

20. A switching mechanism for stapling modes of a stapler of claim 13, wherein the said supporting member further comprises two symmetrical pivot tubes on two sides with a further torsion spring being fitted on it, wherein the said further torsion spring has two symmetrical spring holes on two sides, a connecting bar between the two said spring holes staying against a back face of the supporting member, and two symmetrical extended feet at two ends pushing against an inner bottom face of the trigger.

* * * * *